US009139778B2

(12) United States Patent
Sack et al.

(10) Patent No.: US 9,139,778 B2
(45) Date of Patent: Sep. 22, 2015

(54) CHEMICAL PROCESS TO RECOVER HYDROCARBONS FROM TAR/OIL SANDS AND TERRA

(75) Inventors: Paul W. Sack, Floresville, TX (US); Bernhard James Gollberg, Texas City, TX (US); Mauricio Salazar, Houston, TX (US); Charles R. McCoy; Shannon Raye McCoy-Sauer, legal representative, Ladera Ranch, CA (US)

(73) Assignee: MDECHEM, INC., Floresville, TX (US)

( * ) Notice: Subject to any disclaimer, the term of this patent is extended or adjusted under 35 U.S.C. 154(b) by 64 days.

(21) Appl. No.: 13/439,851

(22) Filed: Apr. 5, 2012

(65) Prior Publication Data

US 2012/0255888 A1 Oct. 11, 2012

Related U.S. Application Data

(60) Provisional application No. 61/472,987, filed on Apr. 7, 2011.

(51) Int. Cl.
*C10G 1/04* (2006.01)
*C10G 1/00* (2006.01)

(52) U.S. Cl.
CPC *C10G 1/04* (2013.01); *C10G 1/047* (2013.01); *C10G 2300/1033* (2013.01)

(58) Field of Classification Search
CPC ..... C10G 1/00; C10G 1/04
USPC ..... 423/179, 332–334, 352, 356
See application file for complete search history.

(56) References Cited

U.S. PATENT DOCUMENTS

| | | | |
|---|---|---|---|
| 4,117,099 | A | 9/1978 | Merkl |
| 5,084,263 | A | 1/1992 | McCoy et al. |
| 5,310,419 | A | 5/1994 | McCoy et al. |
| 5,540,788 | A | 7/1996 | Defalco et al. |

OTHER PUBLICATIONS

Li, H. (2005). Ind. Eng. Chem. Res., 44, 4753-4761.*
Shimada, K. et al. (1980). Bulletin of the Chemical Society of Japan, 53(12), 3488-3491.*
Greenberg, S.A. et al. (1955). Journal of Physical Chemistry, 59(5), 435-440.*
Bunger et al., "Compound types and properties of Utah and Athabasca tar sand bitumens", *Fuel,* 58: 183-195, 1979.
Czarnecki et al., "On the nature of Athabasca oil sands", *Adv Colloid Interface Sci.,* 114-115: 53-60, 2005.
"Sodium and Potassium Silicates", Brochure published by PQ Europe, Oct. 2004.

* cited by examiner

*Primary Examiner* — Brian McCaig
(74) *Attorney, Agent, or Firm* — Parker Highlander PLLC

(57) ABSTRACT

This is directed to a novel chemical mixture process resulting in the production of an inorganic polymeric water complex with enhanced surface acting agent characteristic derived from the synergistic effects caused by individual chemical mechanisms within the mixture that is capable of separating, extracting and recovering hydrocarbons from tar/oil sands, oil shale, petroleum tailings or other types of terra based hydrocarbons.

11 Claims, No Drawings

CHEMICAL PROCESS TO RECOVER HYDROCARBONS FROM TAR/OIL SANDS AND TERRA

CROSS REFERENCE TO RELATED APPLICATIONS

This application claims priority to U.S. provisional patent application 61/472,987 filed on Apr. 7, 2011.

FIELD OF THE INVENTION

This invention relates to chemical processes to produce an inorganic chemical surface acting agent chemical mixture which can be used to extract and recover oil and oil products from oil sand, tar sand, petroleum tailings or other types of oil containing terra.

BACKGROUND OF THE INVENTION

U.S. Pat. No. 4,117,099 issued to Merkl first explained that water soluable multi-metal inorganic complexes can be used to remove sulfur dioxide from effluent gas streams. Subsequently, U.S. Pat. No. 5,084,263 issued to McCoy explained a more elaborate method of preparing inorganic polymetric water complexes for a variety of uses, including removal of organic material from soil (in particular clay), but provides no theory on concentrations or how to accomplish this efficiently. Rather, McCoy raises the possibility of hydrocarbon removal from soil, but leaves it to future inventors to develop the process.

Czarnekia, et al. propose in "On the nature of Athabasca Oil Sands" (2005) notes that it is theoretically possible to remove bitumen (a heavy form of oil) from inorganic solids due to the chemistry of the substances, but offers no theory on how to accomplish this. Similarly, Bunger in "Compound types and proper ties of Utah and Athabasca tar sand bitumens," notes that naturally occurring alcohols can remove some hydrocarbons from sand, but offers no theory on how using a sodium silicate solution to do this might work.

BRIEF SUMMARY OF THE INVENTION

The invention proceeds in two parts to finish the work of McCoy and resolve the questions in the literature. The first part explains a chemical process to produce an inorganic chemical surface acting agent chemical mixture with enhanced and synergistic inorganic surface acting agent characteristics. The second part explains how to use the mixture of the first part in a process to extract and recover oil and oil products from hydrocarbon containing terra such as oil sand, tar sand, petroleum tailings or other types of hydrocarbon containing terra based upon the utilization of the above identified inorganic chemical surface acting agent.

One skilled in the science and technologies of surface acting agents and the associated chemicals utilized in this invention, which are associated with the separation, extraction and recovery of oil and oil products from oil sands, tar sands, petroleum tailings or others types of hydrocarbon containing terra, will quickly perceive the embodiment of this invention and understand its particular characteristic and apparent advantages.

The key feature of this invention is that the chemical mixture with enhanced and synergistic inorganic surface acting agent characteristics can be combined and diluted with water and then mixed in with oil sands, tar sands, oil shale, petroleum tailings or with other types of oil containing terra to create a slurry blend where terra and oil based hydrocarbons can be easily extracted and recovered.

DETAILED DESCRIPTION OF THE INVENTION

Embodiments of the present invention overcome many of the obstacles associated with removing hydrocarbons from tar/oil sands and terra, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements.

The inorganic polymeric water complex surface acting agent to create the chemical surface acting agent chemical is directly based upon McCoy (cited above) that identifies a family of chemical compositions of matter prepared by reacting, in the presence of aqueous ammonia or other source of reactive NH.sub.2 groups, an alkali metal hydroxide to raise pH above 12, and further reacting with the addition of a mineral acid.

These chemical compounds formed by highly exothermic reactions, contacting a mineral acid with ammonium hydroxide and an alkali metal hydroxide in an aqueous solution, the resultant complexes so generated by the described reactions, and the aqueous solutions containing same. Classical chemistry teaches that when an alkali metal hydroxide is introduced into an aqueous solution which contains ammonium hydroxide a reaction occurring reducing ammonium hydroxide (NH 4 OH) to ammonia gas (NH 3) which is then expelled from the solution.

A quantity of an alkali metal hydroxide, preferably potassium hydroxide is first introduced into an aqueous medium in an open reaction vessel creating an initial solution. Next, ammonium hydroxide is mixed with the initial solution by pouring until such time as a stoichiometric quantity of ammonium hydroxide exists. The reaction is slightly exothermic and at end point, remains an aqueous solution, which can be clear, and an ammonia gas smell. This aqueous solution can then be contacted with amounts of any mineral acid species which could be a phosphorus containing acid, a halogen containing acid, a carbon containing acid, a sulfur containing acid, a nitrogen containing acid, or combination of these acids to create a highly exothermic reaction and to continue the reaction until such time as the ammonia gas smell is no longer present creating an inorganic polymeric water complex similar to McCoy. Differing from McCoy's solution is the addition of a sodium silicate additive that provides substantially greater ability to remove hydrocarbons from terra as explained below.

The adding of the strong acid and the alkali hydroxide mixture results in highly exothermic reactions with temperatures immediately rising to over 180 degrees Fahrenheit. These reactions run from a violent exothermic reaction when sulfuric is the reacted acid and a less violent exothermic reaction when a phosphorus or carbon acid is reacted or a controlled reaction when a halogen acid is the reactant.

Laboratory studies concluded that use of an open reaction vessel was best suited for the reaction due to the violent evolution of heat and gases would give rise to explosive reactions in closed or narrow necked reactor vessels. The reaction does not become unstable, but is controllable when reactants are added in the prescribed manner. After initial introduction of the acid into the bases the pH starts to change, then the pouring can be accelerated as a pH of 12 is approached from the alkaline side. The reaction calms down between a pH of 4 on the acidic side and pH of 10 on the alkaline side. The reaction can then be brought to a desired end point of a pH of 7, and clear stable solutions exist.

The inorganic polymeric water complex is then further reacted by the addition of an alkali metal hydroxide until the inorganic polymeric water complex surface acting agent pH is raised to any a desired end point on 12.

The chemical surface acting agent chemical mixture provides many advantages. First, the sodium silicate additive of the chemical mixture has natural occurring bond to sand and other terra thus converting the surface hydrophobic to hydrophilic and the oil or tar is released from the terra material surface. Second, this chemical mixture breaks tight oil/water emulsions that have clay in the matrix based upon the theory that these new compounds have a more positive charge that then unites with the OH-groups on the clay, thereby releasing the oil and water.

Turning to the process, the chemical surface acting agent chemical mixture is applied to tar sands, oil sands, oil shale, petroleum tailings or others types of hydrocarbon containing terra. This creates a slurry blend derived from the mixing of the inorganic chemical surface acting agent chemical mixture, water and materials from either oil sands, tar sands, oil shale, petroleum tailings or others types of hydrocarbon containing terra. In some embodiments, this inorganic chemical surface acting agent chemical mixture concentration level within the slurry blend ranges from 1,500 ppm to 15,000 ppm. At this point, kinetic energy by mechanical agitation or some other method is utilized to achieve maximum material separation within the slurry blend. This process works most effectively when the mechanical energy and environmental conditions cause the slurry blend temperature to rise above 50 degrees Fahrenheit.

That which is claimed:

1. A chemical process to separate hydrocarbons from hydrocarbon containing terra, comprising, contacting hydrocarbon containing terra with water and a surface acting agent, wherein the surface acting agent comprises an aqueous solution having a pH of 12 or greater and comprising an alkali metal hydroxide, ammonium hydroxide, a mineral acid, water and sodium silicate, wherein the contacting forms a slurry blend wherein the hydrocarbon is released from the terra material surface of the hydrocarbon containing terra.

2. The chemical process of claim 1, wherein the alkali metal hydroxide is potassium hydroxide; and the mineral acid is selected from the group consisting of: a phosphorus containing acid, a halogen containing acid, a carbon containing acid, a sulfur containing acid, and a nitrogen containing acid.

3. The chemical process of claim 2, further comprising, applying kinetic energy to the slurry blend.

4. The chemical process of claim 3, wherein the kinetic energy is applied using mechanical agitation.

5. The chemical process of claim 4, wherein the mechanical agitation and environmental conditions results in the temperature of the slurry blend rising to above 50° F.

6. The chemical process of claim 4, wherein the hydrocarbon containing terra is tar sand.

7. The chemical process of claim 2, wherein the hydrocarbon containing terra is oil sand, tar sand, oil sand, oil shale, or petroleum tailings.

8. The chemical process of claim 2, wherein the hydrocarbon is oil.

9. The chemical process of claim 2, wherein the hydrocarbon is tar.

10. The chemical process of claim 2, wherein the mineral acid is a phosphorus containing acid.

11. A surface acting agent, where the surface acting agent comprises an aqueous solution having a pH of 12 or greater and comprising potassium hydroxide, ammonium hydroxide, a phosphorus containing acid, sodium silicate, and water.

* * * * *